US006027785A

United States Patent [19]

Yoshida

[11] Patent Number: 6,027,785

[45] Date of Patent: Feb. 22, 2000

[54] IMPACT ABSORBING NET AND A METHOD FOR ABSORBING IMPACT

[75] Inventor: Hiroshi Yoshida, Oyabe, Japan

[73] Assignee: Yugen Kaisha Yoshiba Kozo Dezain, Oyabe, Japan

[21] Appl. No.: 09/121,126

[22] Filed: Jul. 23, 1998

[30] Foreign Application Priority Data

Jun. 8, 1998 [JP] Japan ..... 10-159110

[51] Int. Cl.[7] ..... B32B 3/24; B21F 27/00

[52] U.S. Cl. ..... 428/131; 256/33; 256/32; 256/54; 256/55; 256/56; 256/47; 256/46; 256/DIG. 3; 245/5; 245/3

[58] Field of Search ..... 428/131; 256/33, 256/32, 54, 55, 56, 47, 46, DIG. 3; 245/5, 3

[56] References Cited

U.S. PATENT DOCUMENTS

| | | | |
|---|---|---|---|
| 170,334 | 11/1875 | Boda | 245/6 |
| 250,020 | 11/1881 | Vieilie | 245/10 |
| 443,472 | 12/1890 | Beisheim | 15/241 |
| 529,719 | 11/1894 | Eils | 52/663 |
| 568,694 | 9/1896 | Thomalla et al. | 66/202 |
| 578,032 | 3/1897 | Smith | 256/46 |
| 1,575,409 | 3/1926 | Blueser | 40/596 |
| 3,066,897 | 12/1962 | Richardson | 245/5 |
| 5,139,234 | 8/1992 | Cochrane | 256/8 |
| 5,597,017 | 1/1997 | Eicher et al. | 140/3 B |

FOREIGN PATENT DOCUMENTS 10-88527 4/1998 Japan .

*Primary Examiner*—William P. Watkins, III
*Attorney, Agent, or Firm*—Nikaido, Marmelstein, Murray & Oram LLP

[57] ABSTRACT

Impact absorbing net for attenuation of impact energy, having continuous ring groups 10*a,* 10*b,* 10*c* . . . of the ropes 20 with the ring clamps 30 provided to hold the ropes 20. The continuous ring groups 10*a,* 10*b,* 10*c* . . . , are each composed of the rings 20*a,* 20*b,* 20*c* in which the rings 20*a,* 20*a* . . . (20*b,* 20*b* . . . , or 20*c,* 20*c* . . . ) are made by one rope. The ropes 20*a,* 20*b,* 20*c* engage each other. Each of the rings 20*a,* 20*b,* 20*c*, has at least one ring clamp 30.

14 Claims, 4 Drawing Sheets

IMPACT ABSORBING NET AND A METHOD FOR ABSORBING IMPACT

BACKGROUND OF THE INVENTION

This invention relates to an impact absorbing net and a method for absorbing impact which attenuates an impact of a snow avalanche, falling rocks, etc. and stops the same.

In a conventional rockfall protection fence, a plural number of horizontal ropes are horizontally stretched between posts provided on a slope. The strength of the posts and the horizontal ropes receive and stop the rockfall. Vertical ropes may be crossed with the horizontal ropes to form nets to prevent the horizontal ropes from spreading open due to the rockfall. Clamps may be provided at the crossing points of respective horizontal ropes and vertical ropes, so that the impact may be attenuated by the frictional resistance caused by the sliding of the ropes in the clamps.

The ropes may be curved. Both ends of the respective rope may be fixed together to form a ring. Then, the inner circumference of each of the respective rings is designed to be in contact with the inner circumference of other rings, thereby forming a chain net. This type of net is disclosed in Japanese Opened Public Patent Application Number Heisei 8-53814 and Japanese Patent Application Publication Number Heisei 10-88527.

In the above-described conventional structure, an impact energy of the falling rocks, etc. is to be received by the strength of the ropes, and is attenuated by the stretching of the ropes or by the frictional resistance caused by the sliding of the ropes in the clamps. Under this method, in order to attenuate a large impact energy, a rope with a larger diameter, a different clamp to increase the force to hold the rope, etc., are used to create a larger frictional resistance caused by sliding. However, using these types of devices or methods not only increases the cost but also is impractical because of its ineffective assemblability and useability.

OBJECTS AND SUMMARY OF THE INVENTION

This invention is made to improve the above points, and to that end, this invention provides an impact absorbing net and a method for absorbing impact, which improves the attenuation of the impact energy.

A further object of the invention is to provide an impact absorbing net and a method for absorbing impact, which can receive a larger amount of impact energy.

The first aspect of the invention is an impact absorbing net, in which the ropes are arranged to form a net and are stretched between posts provided at certain intervals, which comprises a plural number of continuous ring groups formed by each rope and a plural number of clamps slidably holding two crossing ropes, wherein a plural number of rings are continuously formed by each one rope forming one of the continuous ring groups, each respective ring of one continuous ring group and a respective ring of another continuous ring group engage each other, and at least one adjustable, ring-shape-holding clamp is provided at the respective ring.

The second aspect of the invention is an impact absorbing net as above, wherein each respective ring is crossed with other rings adjacent to the ring.

The third aspect of the invention is an impact absorbing net as above, wherein the ring clamps are provided at the points where each rope crosses itself to form the ring.

The fourth aspect of the invention is an impact absorbing net as above, wherein the ring clamps are provided at the points where each rope crosses itself to form the ring, and the ring clamps are provided between adjacent rings.

The fifth aspect of the invention is an impact absorbing net as above, wherein the ring clamps are provided at the points where each rope crosses itself to form the ring, the ring clamps are provided between adjacent rings, and the ring clamps are provided between adjacent continuous ring groups.

The sixth aspect of the invention is an impact absorbing net as above, in which the ring clamp comprises an intermediate member with cavities on both surfaces enabling the installation of the ropes, and an outer member with cavities on one surface facing each opposite surface of the intermediate member enabling the installation of the rope, and bolts and nuts to connect the members, wherein the frictional resistance caused by the sliding of the ropes between the members is adjustable by a degree of tightening of the bolts and nuts.

The seventh aspect of the invention is a method of absorbing impact, in which an impact is attenuated by the impact absorbing net with a net of rope, wherein one of the impact absorbing nets as above is used, an impact energy is dispersed to the whole rings, an impact energy being attenuated by the deformation of the respective ring, and by the combination of the effect of the ring clamps provided at the adjacent rings and the frictional resistance caused by the sliding of the ropes.

BRIEF DESCRIPTION OF THE DRAWINGS

The above and other objects and the attendant advantages of the this invention will become readily apparent by reference to the following detailed description when considered in conjunction with the accompanying drawings wherein.

EMBODIMENT 1 OF THE INVENTION

This embodiment of the invention is explained with reference to the following diagrams.

Figure 1:
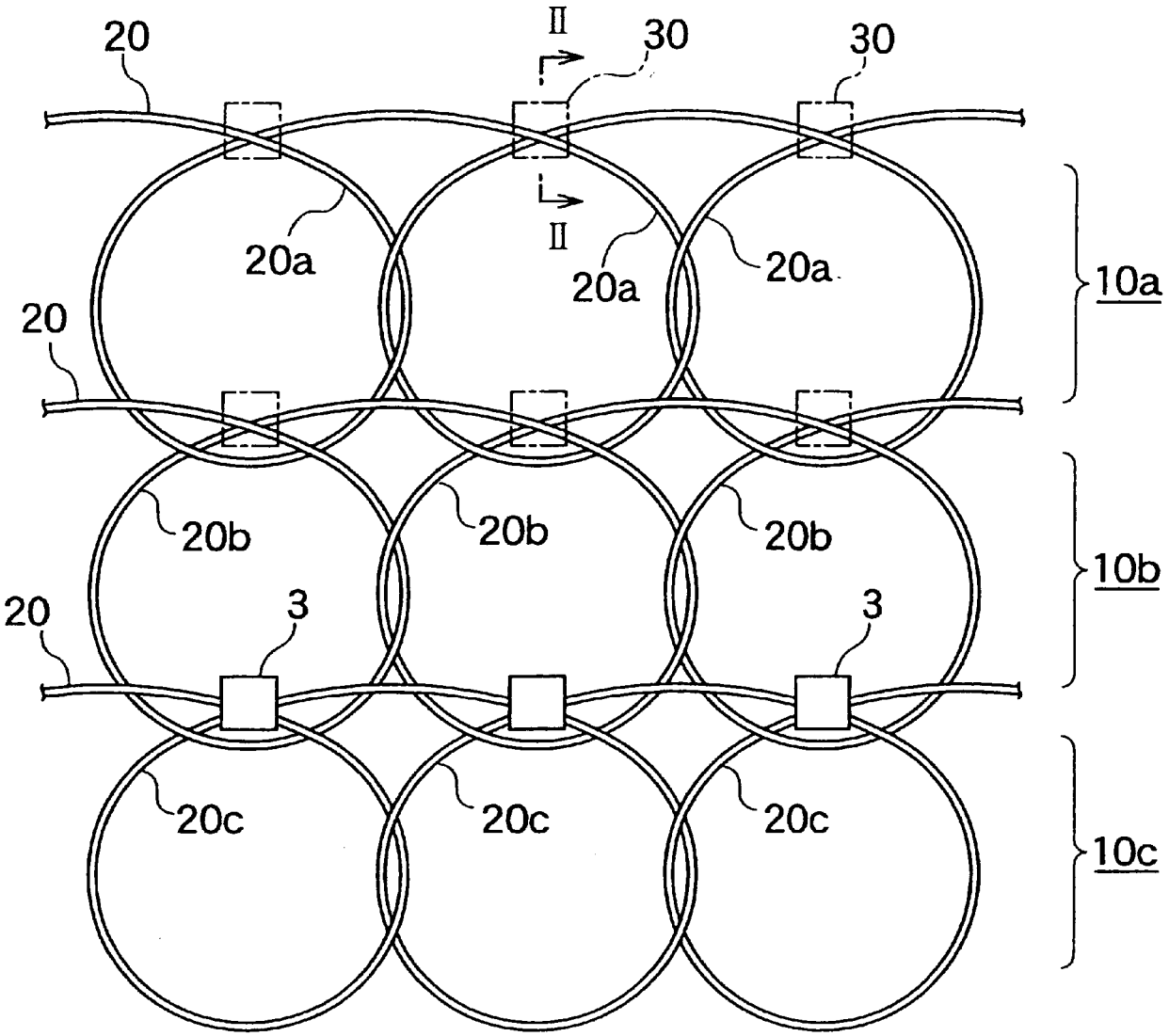
FIG. 1 is a plan view of the impact absorbing net with respect to the embodiment 1 of the invention.

FIG. 1 is an example of the impact absorbing net. The impact absorbing net comprises a plural number of continuous ring groups 10*a*, 10*b*, 10*c* . . . and a plural number of adjustable ring shape holding clamps 30.

Each ring groups 10*a*, 10*b*, 10*c* . . . is adjacent to and engages each other. In this invention, an engagement means the condition which the rope 20 may freely transfer the force from one group to the other group regardless of crossing of the ropes.

The crossing directions of the impact absorbing net in this invention are not limited to the directions shown in FIG. 1, and for example, the upper and lower rings can be reversed or the rings can be rotated in 90 degrees or 45 degrees relative to a horizontal line in the drawing.

The continuous ring group 10*a* is one rope 20 which is looped or spiraled to form a plural number of rings 20*a*, 20*a* . . . The other continuous ring groups 10*b*, 10*c* . . . , each is a similarly looped or spiraled rope forming a plural number of rings 20*b*, 20*b* . . . 20*c*, 20*c* . . .

The rings 20*a*, 20*a* . . . engage each other, and 20*b*, 20*b* . . . and 20*c*, 20*c* . . . engage in the same way. Then, the rings 20*a* and 20*b,* 20*b* and 20*c* of the adjacent continuous ring groups 10*a,* 10*b* engage each other. This is to continuously connect the continuous ring groups 10*a,* 10*b,* 10*c* . . .

The structure of the continuous ring groups 10*a,* 10*b,* 10*c* . . . is explained next.

The continuous ring groups 10*a,* 10*b,* 10*c* . . . , each as explained above, comprises one rope 20 to form the rings 20*a,* 20*a* . . . , 20*b,* 20*b* . . . 20*c,* 20*c* . . . , and so on. When the force such as the stretching force is applied, the diameter of the respective ring 20*a,* 20*b,* or 20*c* may be varied to be smaller.

Also, the shape of the rings 20*a,* 20*b,* or 20*c* may be an oval, a triangle, a rectangle, any other shapes, or the combination of these shapes.

The rope of the impact absorbing net is preferably a wire rope; however, a copper wire, a carbon fiber, or an aramid fiber rope may be substituted.

At least one adjustable ring clamp 30 is provided at each ring. The first embodiment of this invention has the ring clamp 30 provided at the crossing points of each loop of the rope 20 forming each of the rings 20*a,* 20*a* . . . (20*b,* 20*b* . . . , 20*c,* 20*c* . . . ).

The ring clamp 30 holds both sides of the crossing ropes. When an impact becomes larger than a predetermined holding force, the ring clamp 30 allows the ropes to slide to adjust the holding force, i.e., the frictional resistance caused by sliding. At least, the ring clamp 30 is designed to create the frictional resistance when the excessive force occurs among the adjacent rings 20*a,* 20*a* . . . 20*b,* 20*b* . . . , 20*c,* 20*c* . . .

Figure 2:
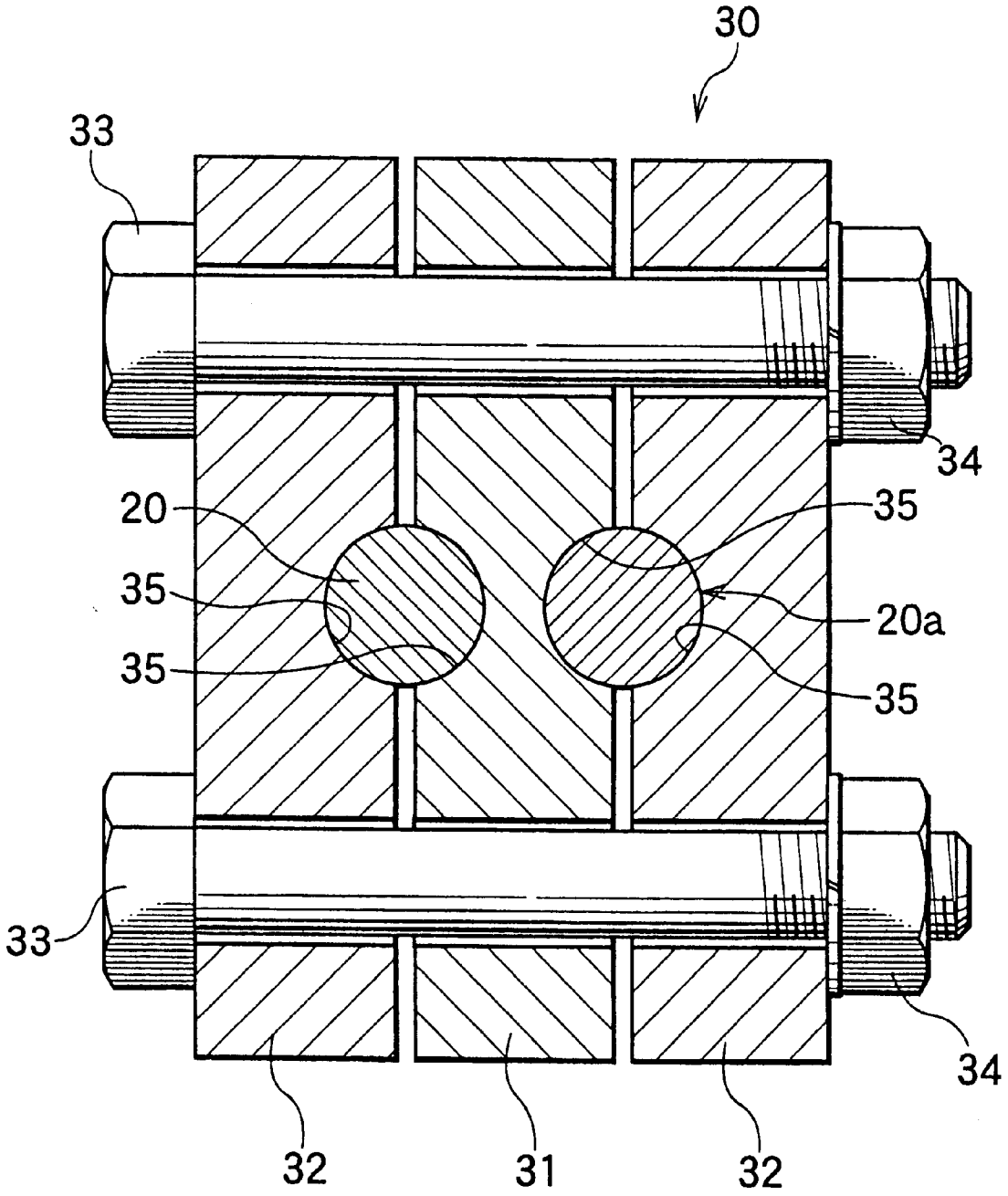
FIG. 2 is a cross section view of FIG. 1 taken along line II—II.

The ring clamp 30 is explained with reference to FIG. 2. The ring clamp 30 comprises an intermediate member 31 with installation cavities 35, which are semicircular when cross-sectioned, on both surfaces, two outer members 32, 32 having the intermediate member 31 in between and corresponding cavities 35, and bolts 33 and nuts 34 fixing these members 31, 32, 32 together with the rope sandwiched therebetween.

The installation cavities 35, which are semicircular when cross-sectioned, are provided on both surfaces of the intermediate member 31 and on the side surface of the outer members 32, 32 facing the intermediate member 31. These installation cavities 35 are capable of holding two portions of the rope 20 for the rings 20*a* (20*b,* 20*c*). The installation cavities 35 are curved to fit the shape of rope, and the installation cavities 35 preferably have wider ends. Protuberances may be formed on the inner circumferential surfaces of the installation cavities to create a larger frictional resistance.

The holding force, i.e., the frictional resistance caused by sliding, may be adjusted by the degree of tightening of the bolts 33 and nuts 34.

The above-described ring clamp is only one example, and any other conventional wire grip or other device, such as placing a rope between two members to be fixed by bolts and nuts, may be used.

The impact absorbing net is stretched between posts just like a traditional net. Another rope is connected between the top portion of the post and the slope behind the net.

The following section explains an impact attenuation effect only by the impact absorbing net, when the falling rocks strike the impact absorbing net, without the attenuation effect of the posts and any other rope.

When the impact absorbing net receives the impact, the impact is transmitted to whole net via the continuous ring groups 10*a,* 10*b,* 10*c* . . . and the rings 20*a,* 20*b,* 20*c*. Then, the impact energy is effectively attenuated by multiplying the following attenuation effects.

First, the impact energy dispersed to whole impact absorbing net is attenuated by deforming the whole net. Then, the impact energy is attenuated by deforming resistance of the ropes caused when the rings 20*a,* 20*b,* 20*c,* are deformed from circular to noncircular. The impact energy effects as the pulling force on the respective rope 20 of the rings 20*a,* 20*b,* 20*c*.

When this pulling force becomes larger than the holding force, i.e., the frictional resistance caused by sliding of the rope in the ring clamp 30, the rope 20 slides to further attenuate the impact energy. As the rope slides, the diameter of the respective ring 20*a,* 20*b,* 20*c* becomes smaller.

The rings 20*a,* 20*b,* 20*c* of the impact absorbing net are continuous, thereby creating the attenuation effect on the impact energy by deforming the rings 20*a,* 20*b,* 20*c* in the direction of decreasing the diameter.

Accordingly, the dispersed energy is effectively and quickly attenuated. The effectiveness of this embodiment is obvious when comparing with the net of many independent rings connected to form a chain-like net.

An experiment is done to compare the attenuation of the above-explained chain-like net having independently formed linked rings with that of the impact absorbing net of this invention. In this experiment, both nets used circular rings with the same diameter.

In the result, the chain-like net attenuated a maximum of 1,500 KJ and the impact absorbing net of this invention attenuated about 4,000 KJ. Here, it was proven that the impact absorbing net of this invention has much larger attenuation effect than the chain-like net.

EMBODIMENT 2 OF THE INVENTION

In the following section, the same devices are marked in the same reference numbers, and the structures and effects of the devices are omitted.

Figure 3:
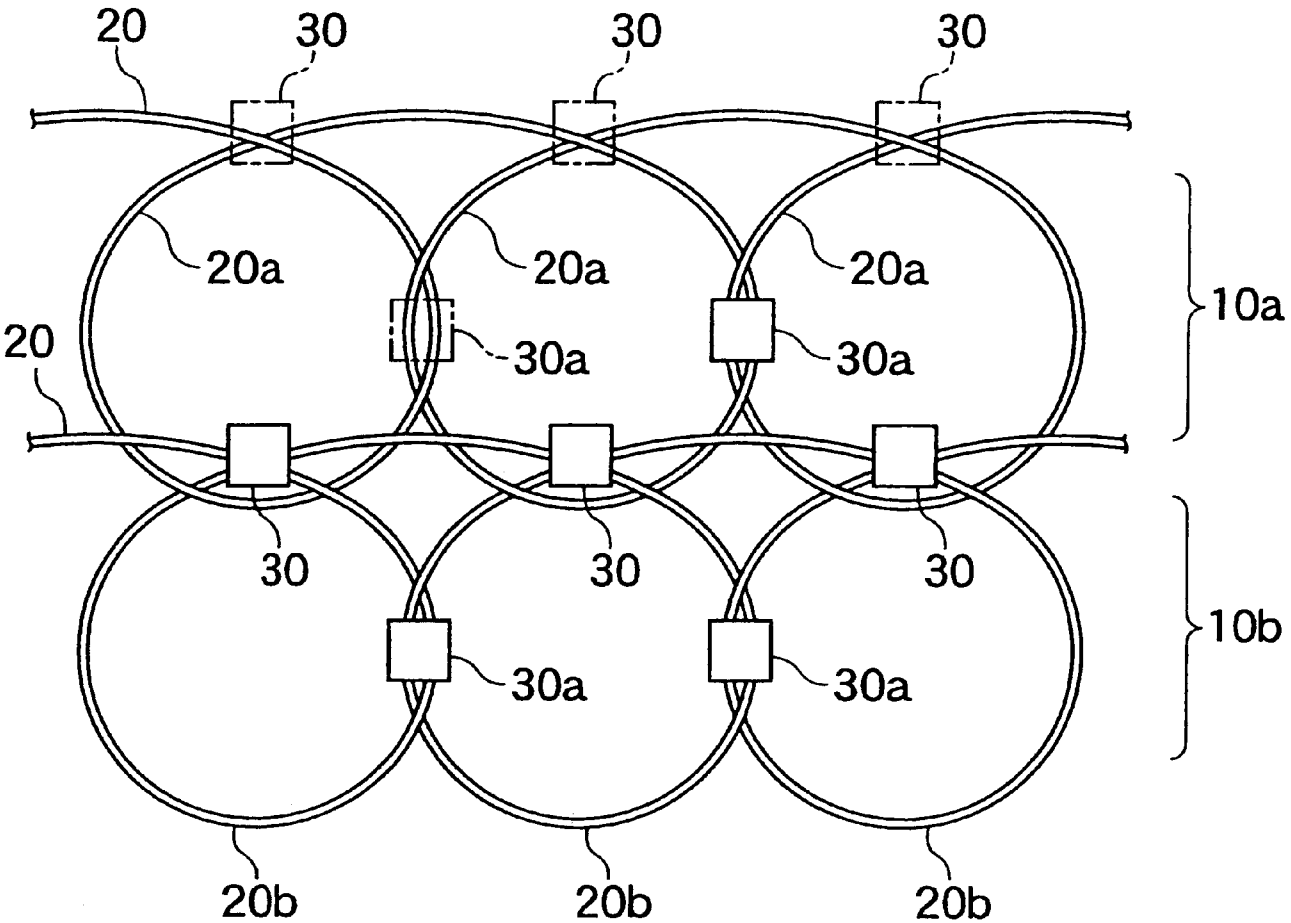
FIG. 3 is a partial plan view of the impact absorbing net with respect to the embodiment 2 of the invention.
Figure 4:
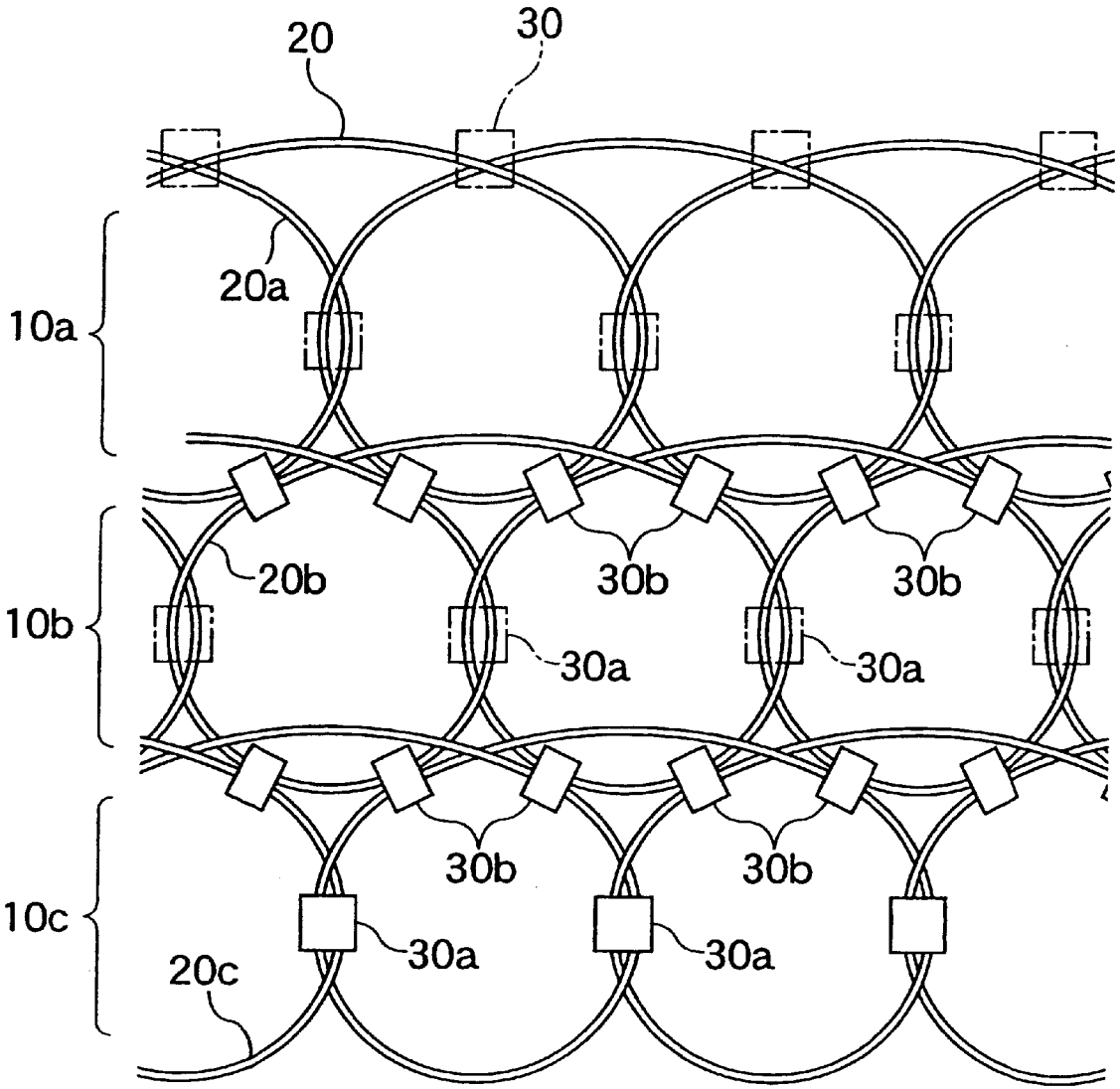
FIG. 4 is a partial plan view of another impact absorbing net with a different location of the ring clamps.

In FIG. 3 and FIG. 4, the positions of the ring clamps 30*a* and 30*b* are added to the above-described first embodiment.

In FIG. 3, the ring clamps 30*a* are added at the adjacent or crossing section of the adjacent rings 20*a,* 20*a* . . . constituting each of the continuous ring groups 10*a,* 10*b,* 10*c*.

Based on FIG. 4 and FIG. 3, the ring clamps 30*b* are also added at the adjacent or crossing section of the rings 20*a,* 20*b,* (20*b,* 20*c* . . . ) of the continuous ring groups 10*a,* 10*b,* 10*c*.

The impact absorbing net of FIG. 3 has a larger attenuation of the impact energy compared with the impact absorbing net of the first embodiment because of the attenuation effect of the ring clamps 30*a* at the crossing sections of the rings 20*a,* 20*a* . . . (20*b,* 20*b* . . . , 20*c,* 20*c* . . . ) besides that of the ring clamps 30 at the crossing sections of the rope 20.

In the impact absorbing net of FIG. 4, the rings 20*a,* 20*b,* 20*c* are placed to form triangles. Six ring clamps 30*a,* 30*b* as well as ring clamps 30 are provided on each respective ring. For example, a ring clamp is provided between the rings 20*a* and 20*b,* 20*b* and 20*c*. Thus, the attenuation of the impact energy becomes larger than the attenuation resulting from the structure shown in FIG. 3.

Locations of the ring clamps 30, 30*a,* 30*b* may be in any combination of the FIGS. 1, 3, and 4.

EMBODIMENT 3 OF THE INVENTION

In the above-explained embodiments, the rings 20*a,* 20*a* . . . , 20*b,* 20*b* . . . , 20*c,* 20*c* . . . of the continuous rope groups 10*a,* 10*b,* 10*c* . . . are crossed to engage each other; and the ropes 20*a* and 20*b,* 20*b* and 20*c* . . . are crossed to engage each other among the continuous ring groups 10*a,*

10*b,* 10*c* . . . However, the rope 20 may simply be arranged to be held by the ring clamp 30, 30*a,* or 30*b* without being crossed among the rings 20*a,* 20*b,* 20*c.*

This invention relates, as explained above, to the impact absorbing net to improve the attenuation of impact energy, comparing with the conventional nets, simply by using the ring clamp at the crossing sections of the ropes or rings, by deforming the rings of the continuous ring groups, and by the frictional resistance caused by the sliding of the rings.

Since this invention especially is able to provide an effective attenuation of a large impact energy, it is suitable for a large rockfall or snow avalanche protection fence or a debris-avalanche dam.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What we claim is:

1. An impact absorbing net, in which ropes are arranged to form a net, the ropes being stretched between posts provided at certain intervals, which comprises a plural number of continuous ring groups formed by each said rope and a plural number of clamps slidably holding two crossing ropes, wherein a plural number of rings are continuously formed by each one rope forming one of the continuous ring groups, each respective ring of one continuous ring group and a respective ring of another continuous ring group engage each other, and at least one adjustable, ring-shape-holding clamp is provided at said respective ring.

2. An impact absorbing net as claimed in claim 1, wherein each respective ring is crossed with other rings adjacent to said ring.

3. An impact absorbing net as claimed in claim 1, wherein said ring clamps are provided at the points where each said rope crosses itself to form said ring.

4. An impact absorbing net as claimed in claim 2, wherein said ring clamps are provided at the points where each said rope crosses itself to form said ring.

5. An impact absorbing net as claimed in claim 1, wherein said ring clamps are provided at the points where each said rope crosses itself to form said ring, and said ring clamps are provided between adjacent rings.

6. An impact absorbing net as claimed in claim 2, wherein said ring clamps are provided at the points where each said rope crosses itself to form said ring, and said ring clamps are provided between adjacent rings.

7. An impact absorbing net as claimed in claim 1, wherein said ring clamps are provided at the points where each said rope crosses itself to form said ring, said ring clamps are provided between adjacent rings, and said ring clamps are provided between adjacent continuous ring groups.

8. An impact absorbing net as claimed in claim 2, wherein said ring clamps are provided at the points where each said rope crosses itself to form said ring, said ring clamps are provided between adjacent rings, and said ring clamps are provided between adjacent continuous ring groups.

9. An impact absorbing net as claimed in claim 1, in which each said ring clamp comprises an intermediate member with cavities on both opposite surfaces enabling the installation of said ropes, and an outer member with cavities on a surface facing each opposite surface of the intermediate member enabling the installation of said ropes, and bolts and nuts to connect said members, wherein the frictional resistance caused by the sliding of said ropes between said members is adjustable by a degree of tightening of said bolts and nuts.

10. An impact absorbing net as claimed in claim 2, in which each said ring clamp comprises an intermediate member with cavities on both opposite surfaces enabling the installation of said ropes, and an outer member with cavities on a surface facing each opposite surface of the intermediate member enabling the installation of said ropes, and bolts and nuts to connect said members, wherein the frictional resistance caused by the sliding of said ropes between said members is adjustable by a degree of tightening of said bolts and nuts.

11. An impact absorbing net as claimed in claim 3, in which each said ring clamp comprises an intermediate member with cavities on both opposite surfaces enabling the installation of said, ropes, and an outer member with cavities on a surface facing each opposite surface of the intermediate member enabling the installation of said ropes, and bolts and nuts to connect said members, wherein the frictional resistance caused by the sliding of said ropes between said members is adjustable by a degree of tightening of said bolts and nuts.

12. An impact absorbing net as claimed in claim 4, in which each said ring clamp comprises an intermediate member with cavities on both opposite surfaces enabling the installation of said ropes, and an outer member with cavities on a surface facing each opposite surface of the intermediate member enabling the installation of said ropes, and bolts and nuts to connect said members, wherein the frictional resistance caused by the sliding of said ropes between said members is adjustable by a degree of tightening of said bolts and nuts.

13. An impact absorbing net as claimed in claim 5, in which each said ring clamp comprises an intermediate member with cavities on both opposite surfaces enabling the installation of said ropes, and an outer member with cavities on a surface facing each opposite surface of the intermediate member enabling the installation of said ropes, and bolts and nuts to connect said members, wherein the frictional resistance caused by the sliding of said ropes between said members is adjustable by a degree of tightening of said bolts and nuts.

14. A method of absorbing impact, in which an impact is attenuated by the impact absorbing net with a net of rope, wherein one of said impact absorbing nets in any one of claims 1–6 is used, impact energy being dispersed to the whole rings, impact energy being attenuated by the deformation of the respective ring, and impact energy being attenuated by the combination of the effect of said ring clamps provided at the adjacent rings and the frictional resistance caused by the sliding of the ropes.

* * * * *